US008142252B1

(12) United States Patent
Krull

(10) Patent No.: US 8,142,252 B1
(45) Date of Patent: Mar. 27, 2012

(54) AMUSEMENT METHODS AND APPARATUS

(76) Inventor: Mark A. Krull, Bend, OR (US)

( * ) Notice: Subject to any disclaimer, the term of this patent is extended or adjusted under 35 U.S.C. 154(b) by 685 days.

(21) Appl. No.: 12/286,956

(22) Filed: Oct. 3, 2008

(51) Int. Cl.
*A43B 23/00* (2006.01)

(52) U.S. Cl. ..... 446/268; 36/136

(58) Field of Classification Search ..... 446/268, 446/26, 85, 118; 472/133; D21/484–505
See application file for complete search history.

(56) References Cited

U.S. PATENT DOCUMENTS

| | | | | |
|---|---|---|---|---|
| 2,367,481 | A | 1/1945 | Burger | 36/17 |
| 2,464,859 | A | 3/1949 | Gilowitz | 2/245 |
| 3,473,198 | A | 10/1969 | Meier | |
| D252,978 | S * | 9/1979 | Bayly | D9/640 |
| 4,205,482 | A * | 6/1980 | Christiansen et al. | 446/97 |
| 4,536,975 | A | 8/1985 | Harrell | 36/136 |
| 4,597,198 | A | 7/1986 | Schweitzer | 36/100 |
| 4,901,452 | A | 2/1990 | Wang | |
| 5,042,119 | A | 8/1991 | Williams | |
| 5,209,000 | A | 5/1993 | Rowland et al. | 36/136 |
| 5,246,749 | A | 9/1993 | Handzlik | 428/8 |
| 5,459,947 | A | 10/1995 | Lasher | |
| 5,496,612 | A | 3/1996 | Ransbottom | 428/99 |
| 5,542,157 | A | 8/1996 | Herman | 24/113 MP |
| 5,671,517 | A | 9/1997 | Gourley | |
| 5,979,085 | A | 11/1999 | Ross et al. | |
| 6,412,197 | B1 | 7/2002 | Krull | 36/136 |
| 6,640,467 | B1 | 11/2003 | Krull | 36/136 |
| 2004/0079011 | A1 * | 4/2004 | Shwartz et al. | 40/329 |

FOREIGN PATENT DOCUMENTS

| | | |
|---|---|---|
| DE | 478711 | 6/1929 |

* cited by examiner

*Primary Examiner* — Gene Kim
*Assistant Examiner* — Amir Klayman

(57) ABSTRACT

Items are releasably interconnected to one another to create amusing assemblies. In one particular application, a humanoid figurine is mounted on a base, which in turn, is mounted on an article of clothing. For example, a LEGO figurine is press fitted onto a base, and the base is secured beneath a closure on a shoe. In another example, the base is secured to the bill of a visor. In still other examples, the base is secured to a shirt pocket or a shirt button. In various applications, the base is configured to support the figurine in more than one orientation. Furthermore, the base or other first item may be provided with one or more walls that surround the figurine or other second item.

22 Claims, 17 Drawing Sheets

Fig. 9
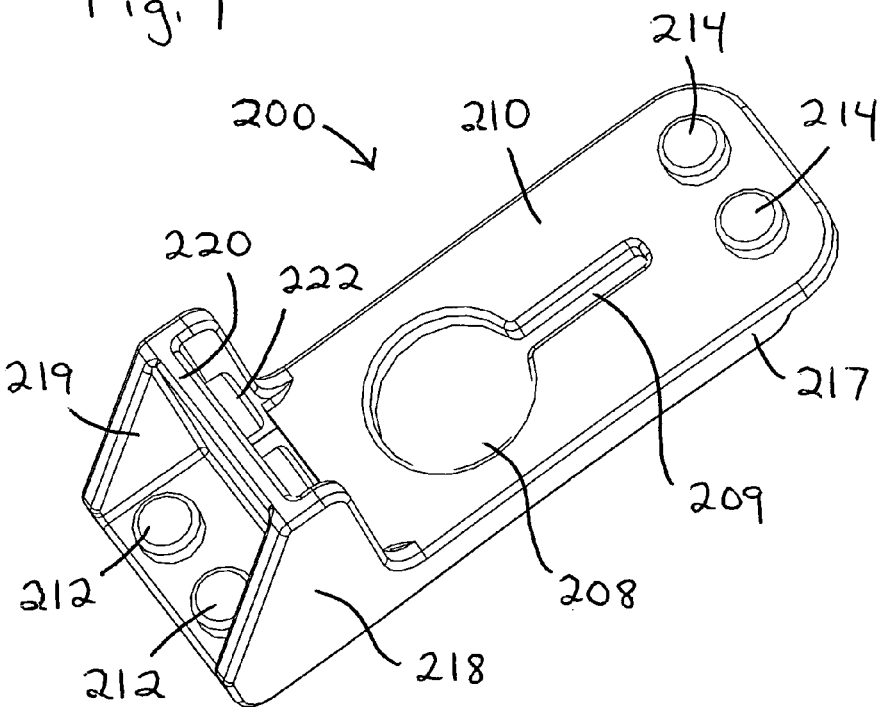
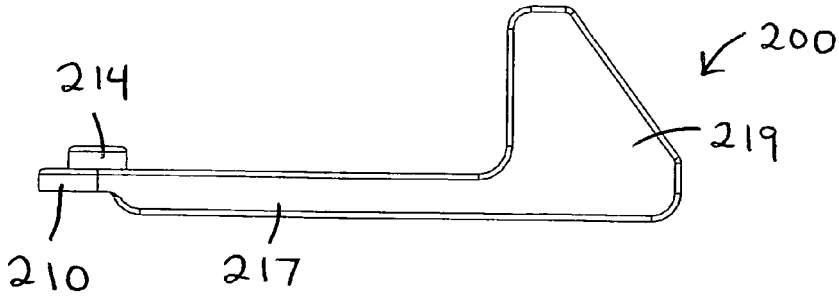
Fig. 10

Fig. 13
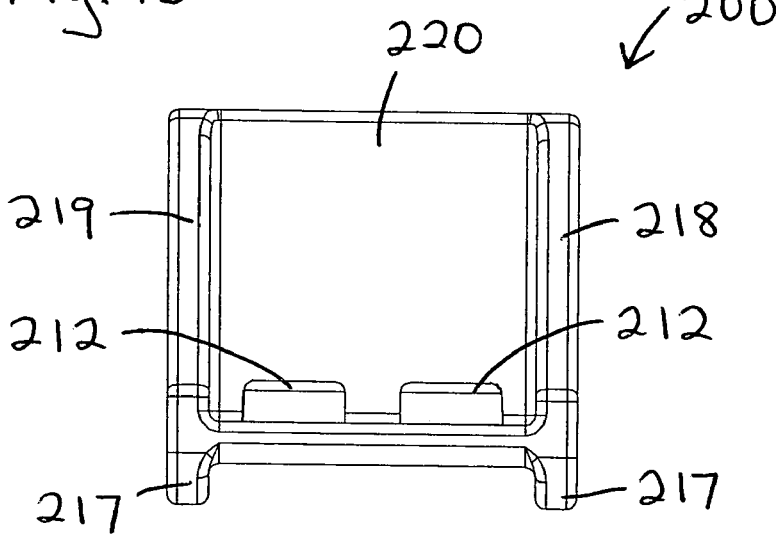
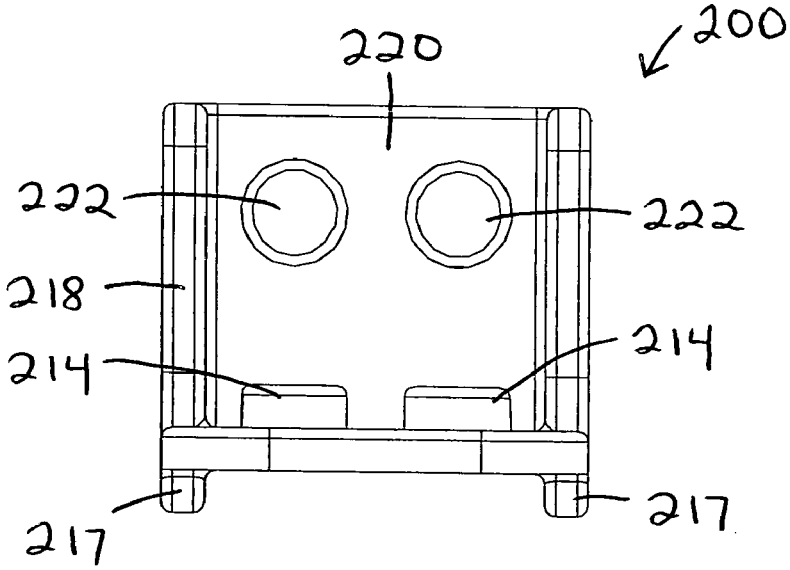
Fig. 14

AMUSEMENT METHODS AND APPARATUS

FIELD OF THE INVENTION

The present invention relates to amusement methods and apparatus, including figurines selectively secured to articles of clothing and press fitted components suitable for use therewith.

BACKGROUND OF THE INVENTION

U.S. Pat. Nos. 6,412,197 and 6,640,467 to Krull disclose various shoe accessory methods and apparatus. An object of the present invention is to provide new and improved ways to adorn one's shoes with certain amusing objects. Another object of the present invention is to adorn other articles of one's clothing with certain amusing objects. Still another object of the invention is to provide new and improved components that press fit together.

SUMMARY OF THE INVENTION

One aspect of the present invention is to selectively secure a figurine relative to an article of clothing. On one embodiment, a base is configured for ornamental attachment to an article of clothing. A first connector member is disposed on a first portion of the base, and a second connector member is disposed on a discrete, second portion of the base. A figurine is selectively connected to the first connector member, and the figurine is alternatively selectively connected to the second connector member. On another embodiment, a base is configured for connection to at least two articles of clothing selected from the group consisting of a shoe, a shirt, and a visor. At least one connector member is mounted on the base, and figurine is selectively connected to the connector member in a standing orientation relative to a standing person wearing each of the at least two articles of clothing.

Another aspect of the present invention is to accommodate LEGO brand blocks at more than one orientation relative to one another. On one embodiment, at least one first peg projects outward from a base in a first direction, and at least one second peg projects outward from the base in a second direction. An angle of at least sixty degrees and at most one hundred degrees is defined between the first direction and the second direction. Also, each peg is configured for connection to a conventional LEGO block.

Yet another aspect of the present invention is to provide a LEGO compatible member with an additional wall. On one embodiment, at least one peg projects outward from a base in a first direction, and at least one wall projects outward from the base in the same first direction. The peg is configured for connection to a conventional LEGO block. The wall accommodates at least one additional peg extending perpendicular to the at least one peg on the base, and/or provides an external barrier about a member press fitted onto the at least one first peg.

Additional features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts throughout the several views.

FIG. 9 is a perspective view of another apparatus constructed according to the principles of the present invention;

FIG. 10 is a side view of the apparatus of FIG. 9 (an opposite side view is a mirror image thereof);

FIG. 13 is an end view of the apparatus of FIG. 9;

FIG. 14 is an opposite end view of the apparatus of FIG. 9;

DETAILED DESCRIPTION OF THE PREFERRED EMBODIMENT

Figure 1:
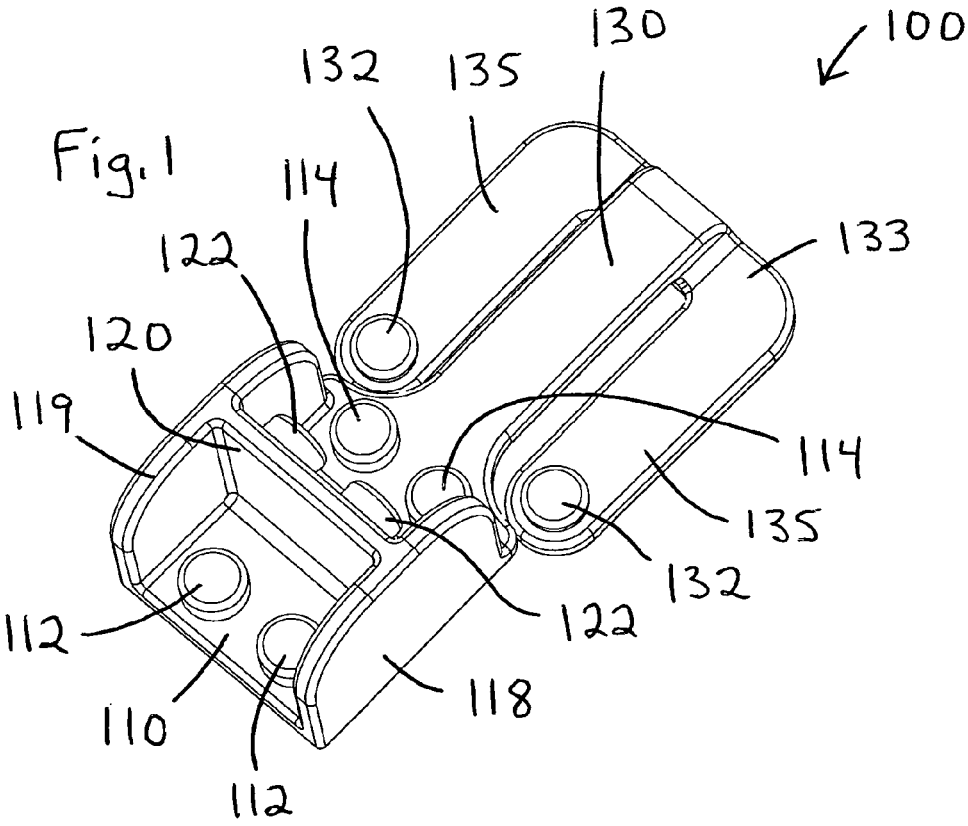
FIG. 1 is a perspective view of an apparatus constructed according to the principles of the present invention.
Figure 2:
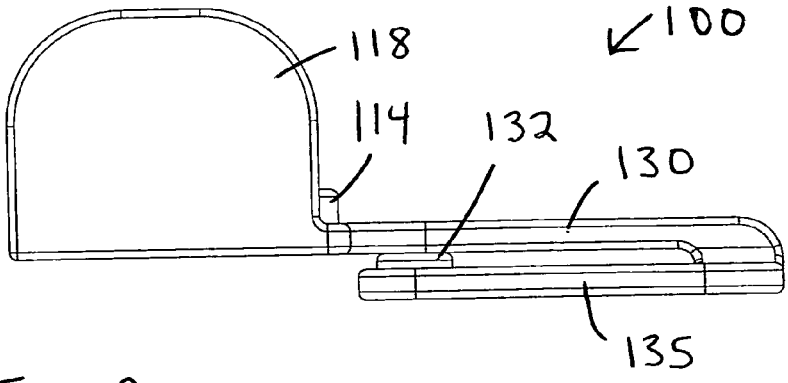
FIG. 2 is a side view of the apparatus of FIG. 1 (an opposite side view is a mirror image thereof)
Figure 3:
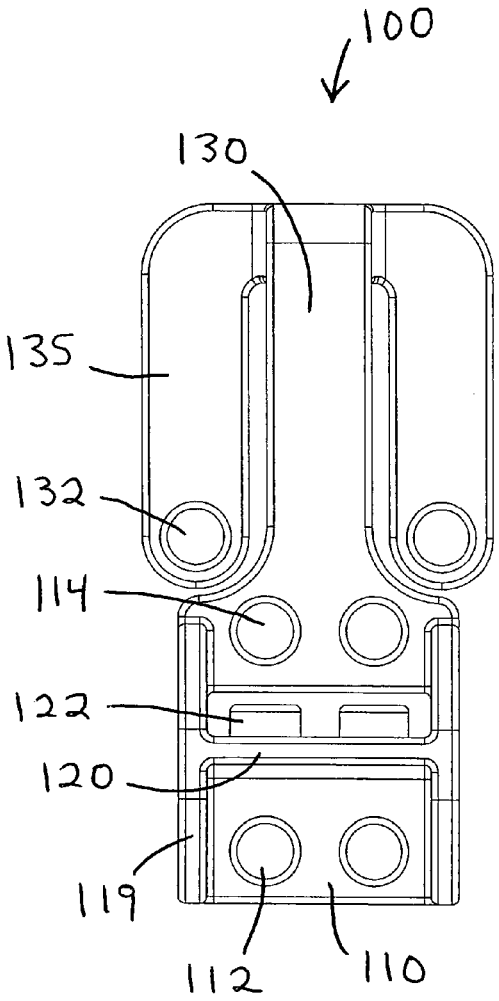
FIG. 3 is a top view of the apparatus of FIG. 1.
Figure 4:
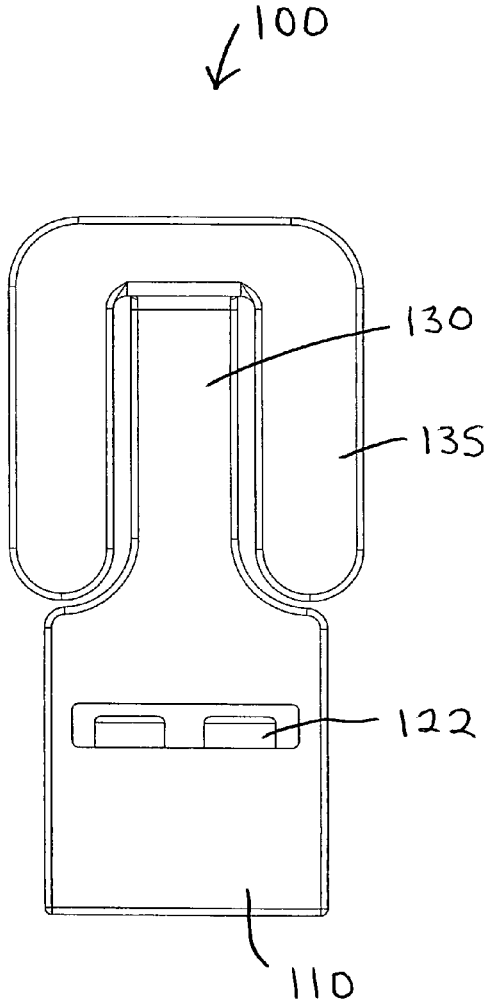
FIG. 4 is a bottom view of the apparatus of FIG. 1.
Figure 5:
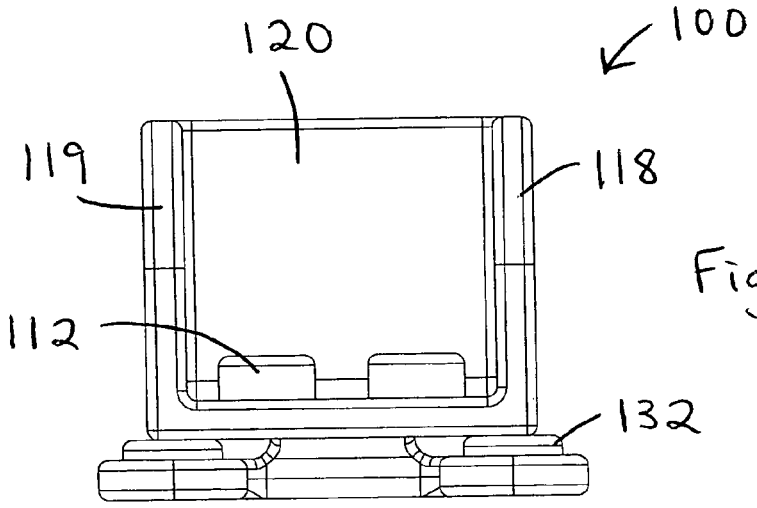
FIG. 5 is an end view of the apparatus of FIG. 1.
Figure 6:
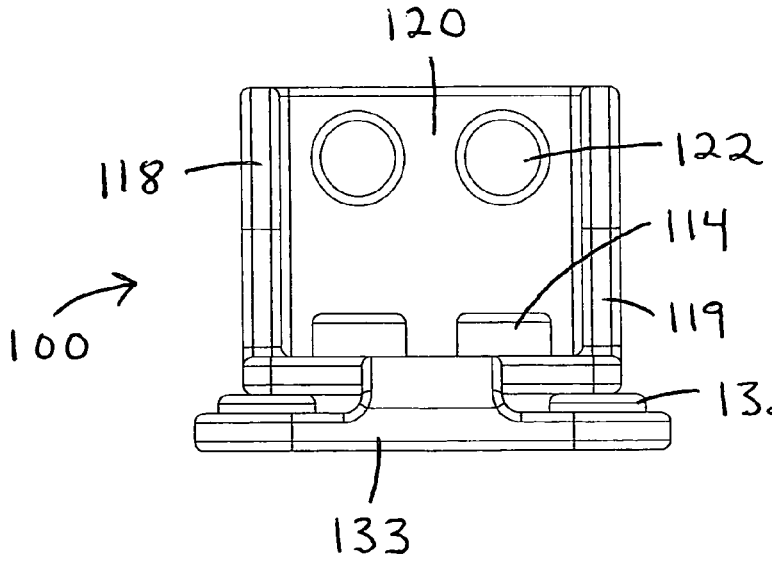
FIG. 6 is an opposite end view of the apparatus of FIG. 1.

A first apparatus constructed according to the principles of the present invention is designated as 100 in FIGS. 1-8. The apparatus 100 is preferably a single piece of injection molded plastic. The apparatus 100 has a base 110 which may be described as a flat panel, and two pairs of pegs 112 and 114 project outward from a first side of the base 110. Opposite first and second sidewalls or flanges 118 and 119 project outward from the same first side of the base 110. A central flange 120 projects upward from the same first side of the base 110 and/or between the opposite sidewalls 118 and 119. One pair of pegs 112 is disposed on one side of the central flange 120, and the other pair of pegs 114 is disposed on an opposite side of the central flange 120. Another, third pair of pegs 122 projects outward from the one side of the central flange 120, in a direction orthogonal to the direction in which the pegs 112 and 114 project. The angle defined between the pegs 122 on the one hand, and the pegs 112 and 114 on the other hand, may be varied on alternative embodiments within the range of sixty degrees to one hundred and twenty degrees, but is most preferably ninety degrees.

The pegs 112, 114, and 122 are preferably similarly configured and aligned with one another, so that a first peg from each pair shares a first common plane of symmetry (extending perpendicular through the central flange 120), and a second peg from each pair shares a second common plane of symmetry (extending perpendicular through the central flange 120). The pegs 112, 114, and 122 are configured and arranged to press fit into adjacent openings in commercially available LEGO products, including openings in the feet 92 of a commercially available LEGO figurine (designated as 90 in FIGS. 7-8).

The flanges 118-120 are configured and arranged to accommodate insertion of the feet of the figurine 90 therebetween. In other words, when the figurine 90 is standing on the base 110 and secured to either the pegs 112 or 114 (see FIG. 7), the flanges 118-120 form a U-shaped enclosure about the feet of the figurine 90. When the figurine 90 is standing on the central flange 120 and secured to the pegs 122 (see FIG. 8), the flanges 118-119 cooperate with the base 110 to form a U-shaped enclosure about the feet of the figurine 90.

The base 110 also includes a prong or tab 130 that extends in the same direction as the pegs 122 project outward from the central flange 120. An outer end of the prong 130 is connected to a central portion of a U-shaped member 133. The U-shaped member 133 has first and second legs or prongs 135 that extend back toward the central flange 120. Each prong 135 terminates in a distal end, and a respective peg 132 projects outward from each distal end, in the same direction as the pegs 112 and 114 project outward from the base 110. The prong 130 is offset or displaced relative to the U-shaped member 133, in the same direction that the pegs 112 and 114 project outward from the base 110, to accommodate a thin, planar sheet of material therebetween. In other words, the prong 130 is configured and arranged to occupy an overlying position relative to a shoe closure or a shirt pocket, whereas the prongs 135 are configured and arranged to occupy respective underlying positions relative to a shoe closure or a shirt pocket.

Figure 7:
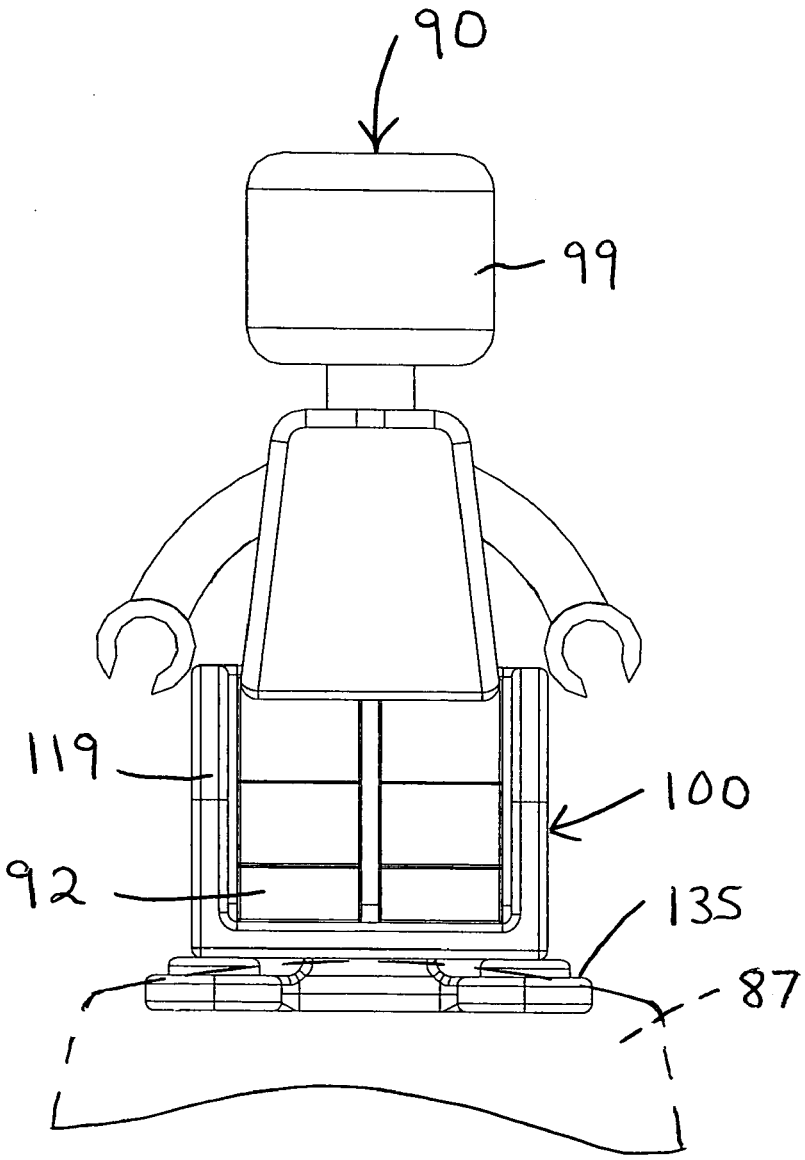
FIG. 7 shows the apparatus of FIG. 1 secured to an article of clothing, and a figurine mounted in a first position on the apparatus.

In one mode of operation, shown in FIG. 7, the apparatus 100 is arranged relative to an article of clothing 87, and a LEGO figurine 90 is mounted on the pegs 112. The article of clothing 87 is drawn diagrammatically to represent either a shoe having laces, or a shoe having hook-and-loop closures. In either case, the apparatus 100 is preferably arranged so the pegs 122 project away from the toe end of a shoe (and away from the reader), and the prongs 135 are inserted beneath one or more closures on the shoe. As a result, the figurine 90 occupies a standing orientation on top of the shoe 87. For additional understanding of this particular arrangement, one may refer to U.S. Pat. Nos. 6,412,197 and 6,640,467 to Krull, which are incorporated herein by reference.

Contrary to the prior art devices disclosed in the above-referenced patents, additional pegs 114 provide an alternative location for supporting the figurine 90 in a standing orientation on the shoe, or for supporting a second figurine 90, either directly or via one or more LEGO blocks secured therebetween. In the lattermost case, the second figurine 90 would occupy a relatively higher position behind the figurine 90 shown in FIG. 7, and two figurine heads 99 would be completely visible in a front view. In the alternative, the figurine 90 may be press fitted onto the pegs 122 to place the figurine 90 in a supine orientation on top of the shoe 87, or in a sitting position on top of the shoe 87. In either case, an article of clothing designated as 88 in FIG. 8 may be construed as a shoe viewed from above, with the apparatus 100 arranged in the same manner as described with reference to FIG. 7 (but with the figurine 90 repositioned).

Figure 8:
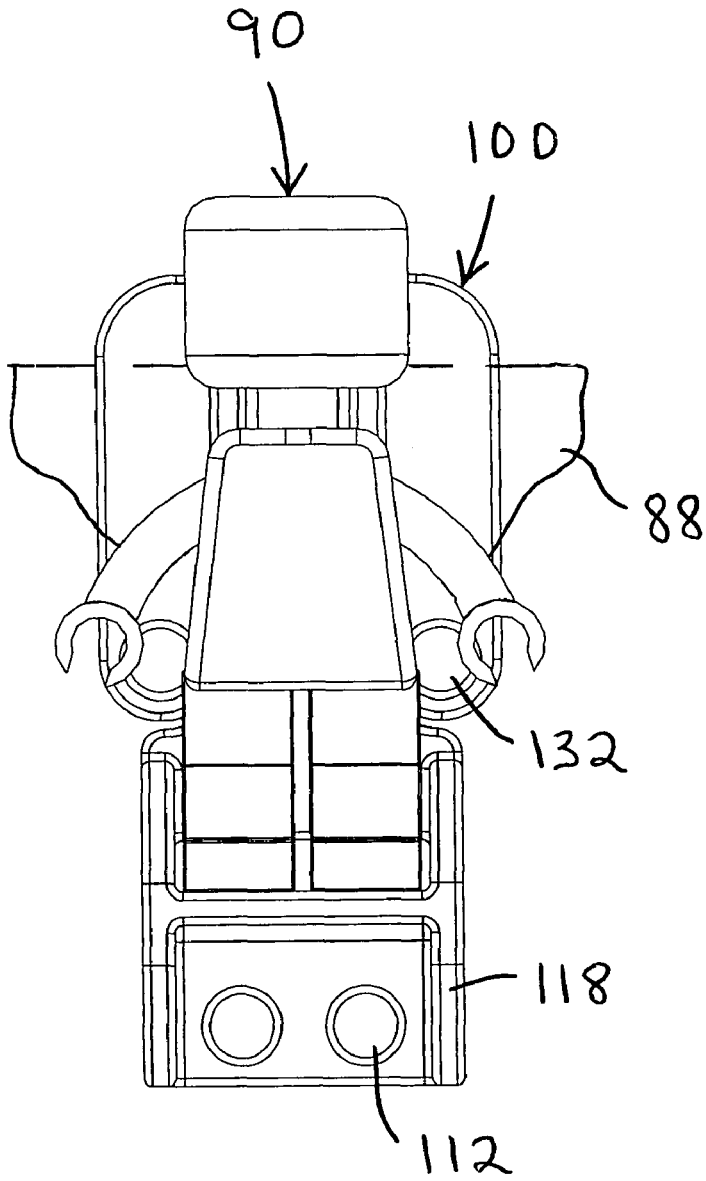
FIG. 8 shows the apparatus of FIG. 1 secured to an article of clothing, and a figurine mounted in a second position on the apparatus.
Figure 11:
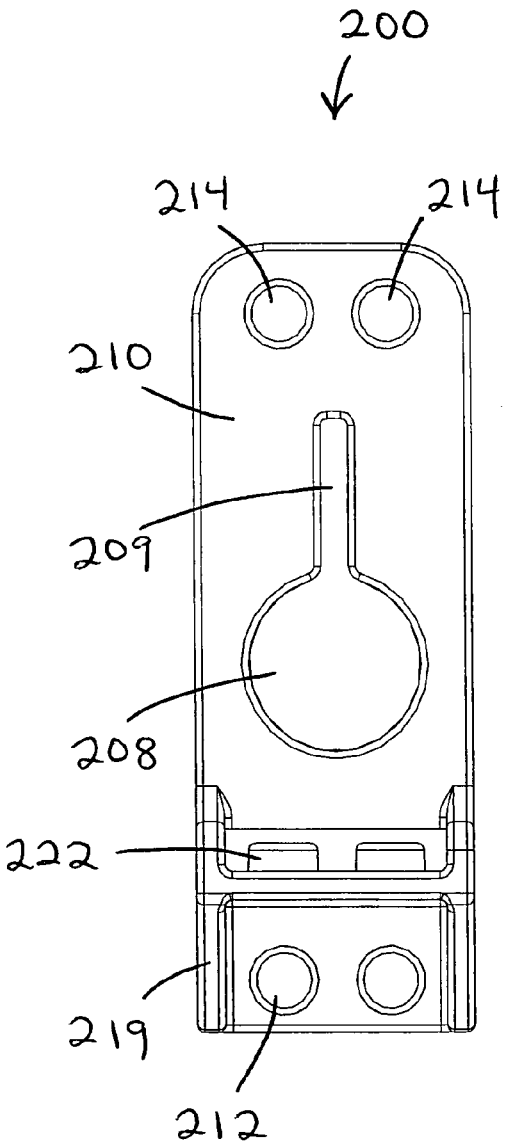
FIG. 11 is a top view of the apparatus of FIG. 9.
Figure 12:
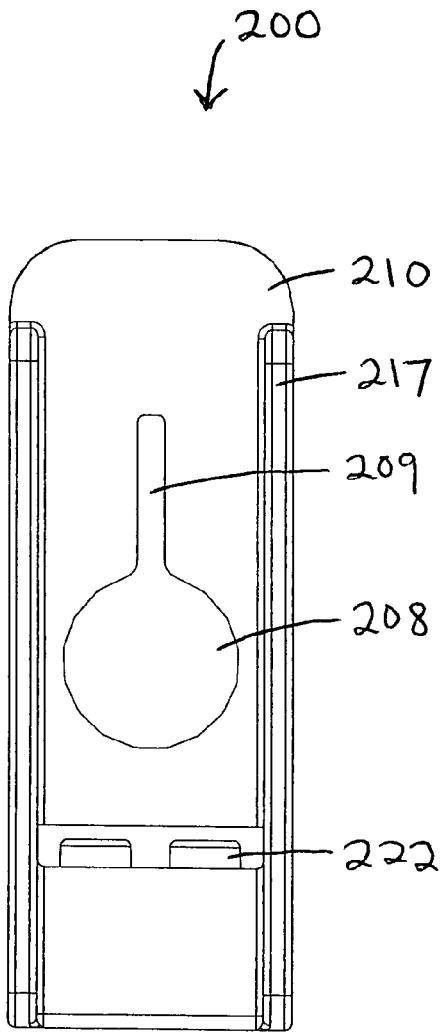
FIG. 12 is a bottom view of the apparatus of FIG. 9.

In another mode of operation, the article of clothing 88 in FIG. 8 may be construed as the front panel of a shirt pocket. In this application, the apparatus 100 is arranged so the pegs 122 project upward, and the prongs 135 are inserted behind the front panel 88 of the shirt pocket, with the remainder of the apparatus 100 disposed in front of the panel 88. The figurine 90 is press fitted onto the pegs 122 to place the figurine 90 in a standing orientation in front of the shirt pocket 88.

In each mode of operation, the pegs 132 encourage the apparatus 100 to remain in position relative to the respective article of clothing 87 or 88. Also, the flanges 118 and 119 reduce the likelihood of the figurine 90 being unintentionally dislodged by incidental contact with one's surroundings. In alternative modes of operation, commercially available LEGO blocks may be used to build a structure on the apparatus 100, or the pegs may be replaced by alternative connector members suitable for retaining alternative figurines.

A second apparatus constructed according to the principles of the present invention is designated as 200 in FIGS. 9-16. The apparatus 200 is preferably a single piece of injection molded plastic. The apparatus 200 has a base 210 which may be described as a flat panel, and two pairs of pegs 212 and 214 project outward from a first side of the base 210. Opposite first and second sidewalls or flanges 218 and 219 project outward from the same first side of the base 210. A central flange 220 projects upward from the same first side of the base 210 and/or between the opposite sidewalls 218 and 219. Opposite side flanges 217 project downward from an opposite, second side of the base 210, and extend along respective edges of the base 210 to enhance the structural integrity of the apparatus 200.

One pair of pegs 212 is disposed on one side of the central flange 220 and proximate one end of the base 210, and the other pair of pegs 214 is disposed on an opposite side of the central flange 220, and proximate an opposite end of the base 210. Another, third pair of pegs 222 projects outward from the one side of the central flange 220, in a direction orthogonal to the direction in which the pegs 212 and 214 project. The pegs 212, 214, and 222 are preferably similarly configured and aligned with one another, so that a first peg from each pair shares a first common plane of symmetry (extending perpendicular through the central flange 220), and a second peg from each pair shares a second common plane of symmetry (extending perpendicular through the central flange 220).

The pegs 212, 214, and 222 are configured and arranged to press fit into adjacent openings in commercially available LEGO products, including openings in the feet 92 of a commercially available LEGO figurine (designated as 90 in FIGS. 15-16), and the flanges 218-220 are configured and arranged to accommodate insertion of the feet of the figurine 90 therebetween. When the figurine 90 is standing on the base 210 and secured to the pegs 212 (see FIG. 15), the flanges 218-220 form a U-shaped enclosure about the feet of the figurine 90. When the figurine 90 is standing on the central flange 220 and secured to the pegs 222 (see FIG. 16), the flanges 218-219 cooperate with the base 210 to form a U-shaped enclosure about the feet of the figurine 90.

A circular hole 208 extends through an intermediate portion of the base 210 to accommodate insertion of a shirt button through the base 210. An elongate slot 209 extends through an intermediate portion of the base 210 and intersects the hole 208 to accommodate sliding of the base 210 downward onto thread interconnected between the button and the shirt. In other words, the base 210 is configured to fit over a shirt button and onto the thread that holds the button in place.

Figure 15:
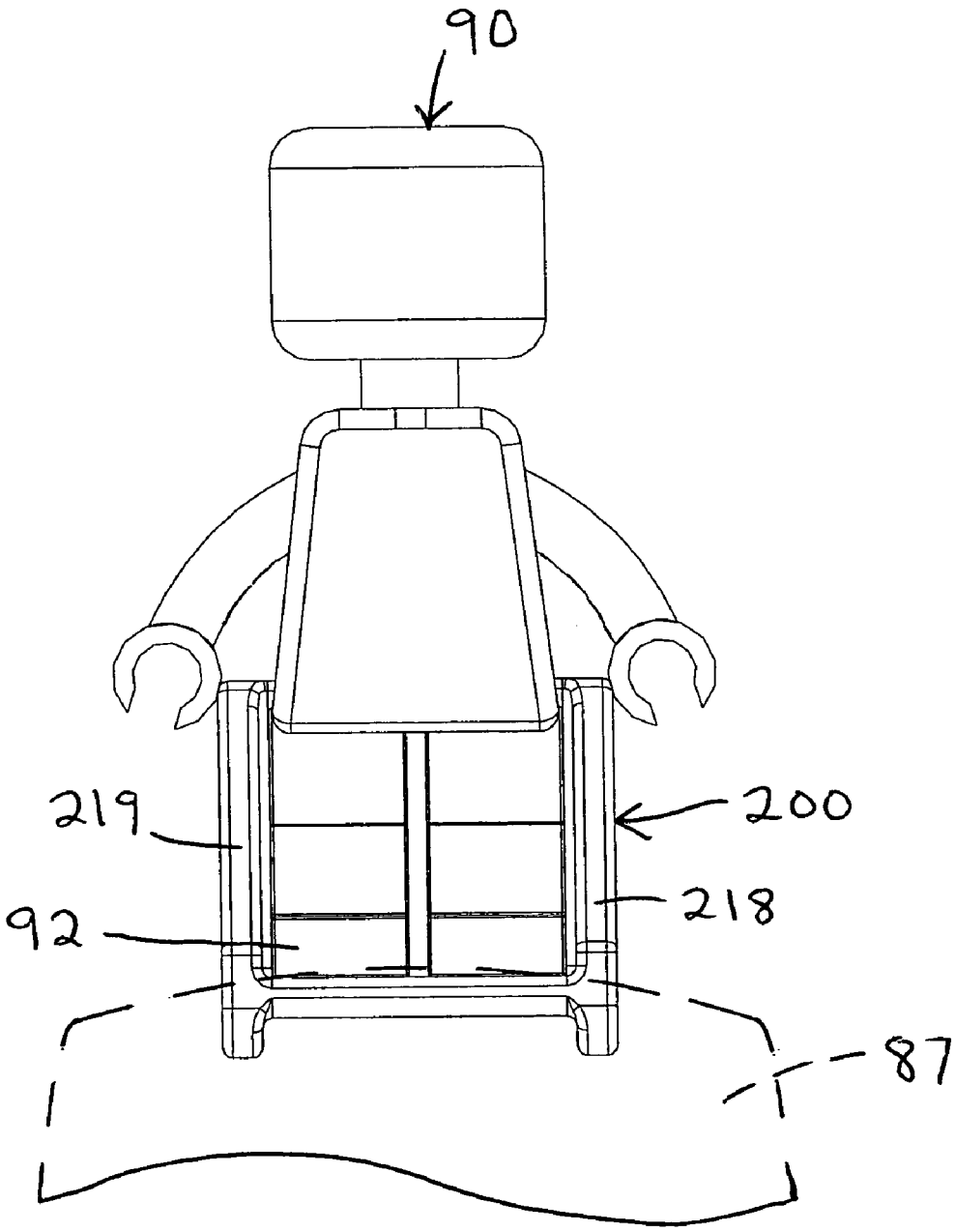
FIG. 15 shows the apparatus of FIG. 9 secured to an article of clothing, and a figurine mounted in a first position on the apparatus.
Figure 16:
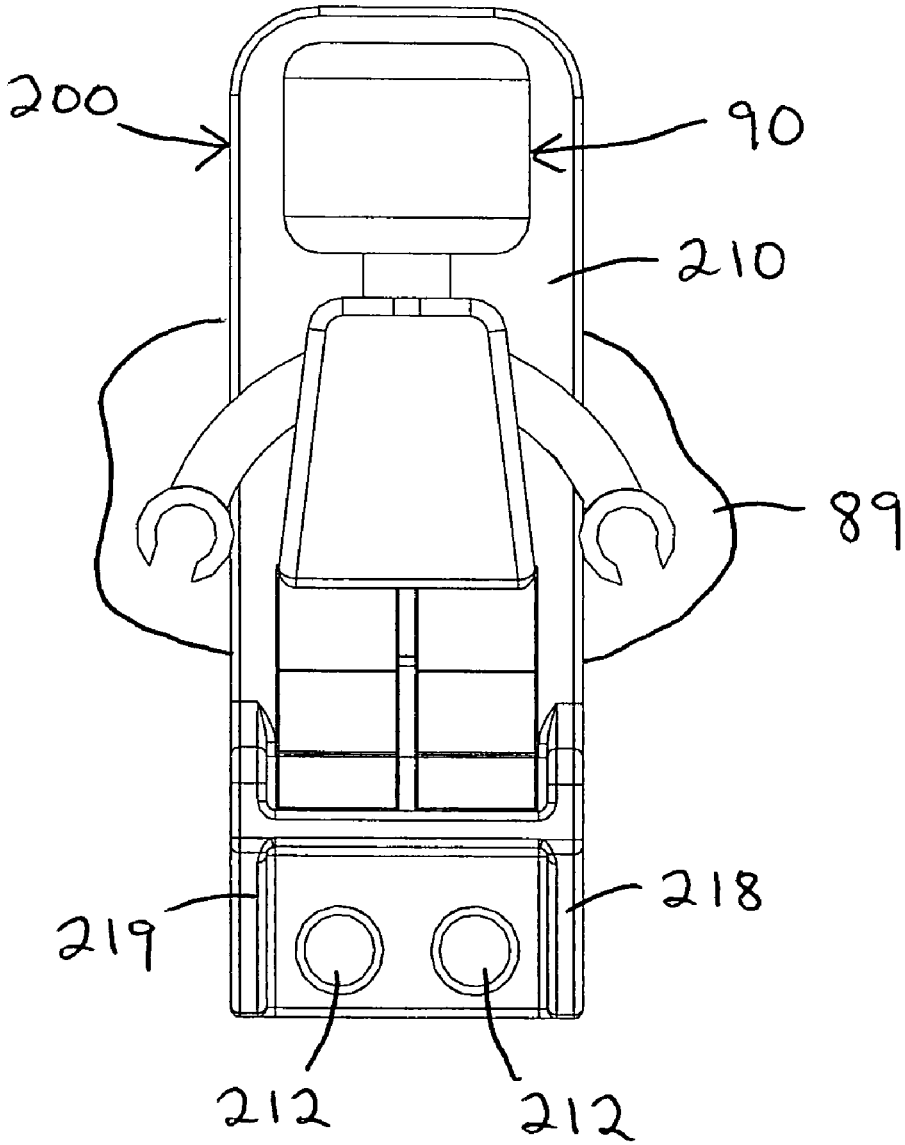
FIG. 16 shows the apparatus of FIG. 9 secured to an article of clothing, and a figurine mounted in a second position on the apparatus.
Figure 17:
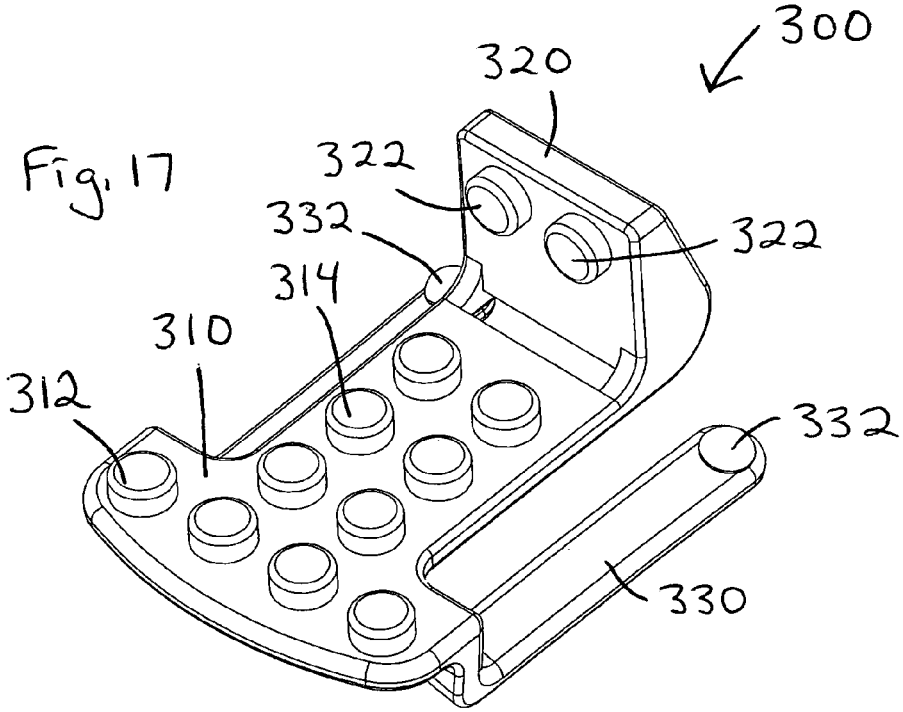
FIG. 17 is a perspective view of yet another apparatus constructed according to the principles of the present invention.

In one mode of operation, shown in FIG. 15, the apparatus 200 is arranged relative to an article of clothing 87, and a LEGO figurine 90 is mounted on the pegs 212. The article of clothing 87 is drawn diagrammatically to represent either a shoe having laces, or a shoe having hook-and-loop closures. In either case, the apparatus 200 is preferably arranged so the pegs 222 project away from the toe end of a shoe (and away from the reader), and the base 210 is inserted beneath one or more closures on the shoe. As a result, the figurine 90 occupies a standing orientation on top of the shoe 87. For additional understanding of this particular arrangement, one may refer to U.S. Pat. Nos. 6,412,197 and 6,640,467 to Krull, which are incorporated herein by reference.

Contrary to the prior art devices disclosed in the above-referenced patents, additional pegs 214 provide an alternative location for supporting the figurine in a standing orientation on the shoe, or for supporting a second figurine, either directly or via one or more LEGO blocks secured therebetween. In the alternative, the figurine 90 may be press fitted onto the pegs 222 to place the figurine 90 in a supine orientation on top of the shoe 87, or in a sitting position on top of the shoe 87. In either case, an article of clothing designated as 89 in FIG. 16 may be construed as a shoe viewed from above, with the apparatus 200 arranged in the same manner as described with reference to FIG. 15 (but with the figurine 90 repositioned). In each instance, the flanges 218 and 219 reduce the likelihood of the figurine 90 being unintentionally dislodged by incidental contact with one's surroundings.

In another mode of operation, the article of clothing 89 may be construed as a shirt. In this application, the apparatus 200 is arranged so the pegs 222 project upward, and the base 210 is maneuvered past a button on the shirt 89 and then downward onto thread interconnected between the button and the shirt 89. The figurine 90 is press fitted onto the pegs 222 to place the figurine 90 in a standing orientation in front of the shirt 89. In other modes of operation, the figurine 90 may be replaced by other types of figurines, and/or commercially available LEGO blocks may be used to build a structure on the apparatus 200.

Figure 18:
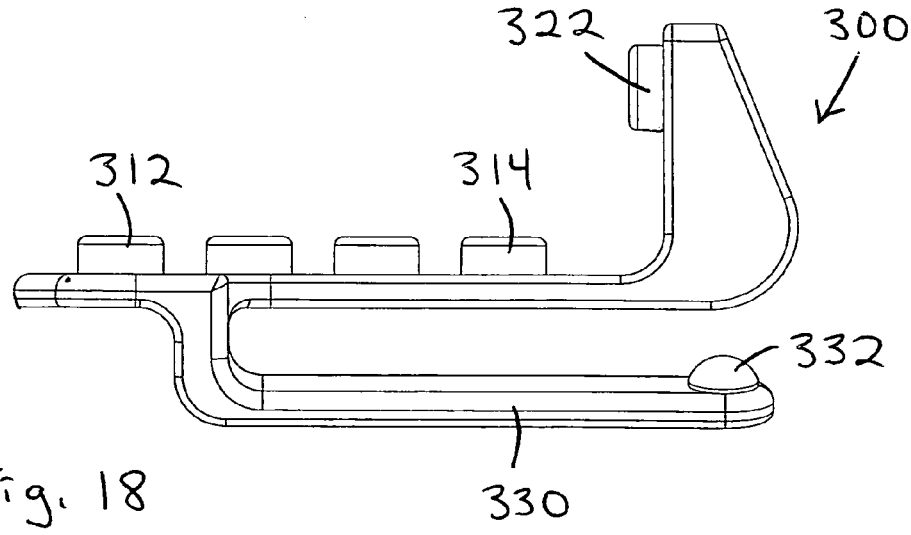
FIG. 18 is a side view of the apparatus of FIG. 17 (an opposite side view is a mirror image thereof)
Figure 19:
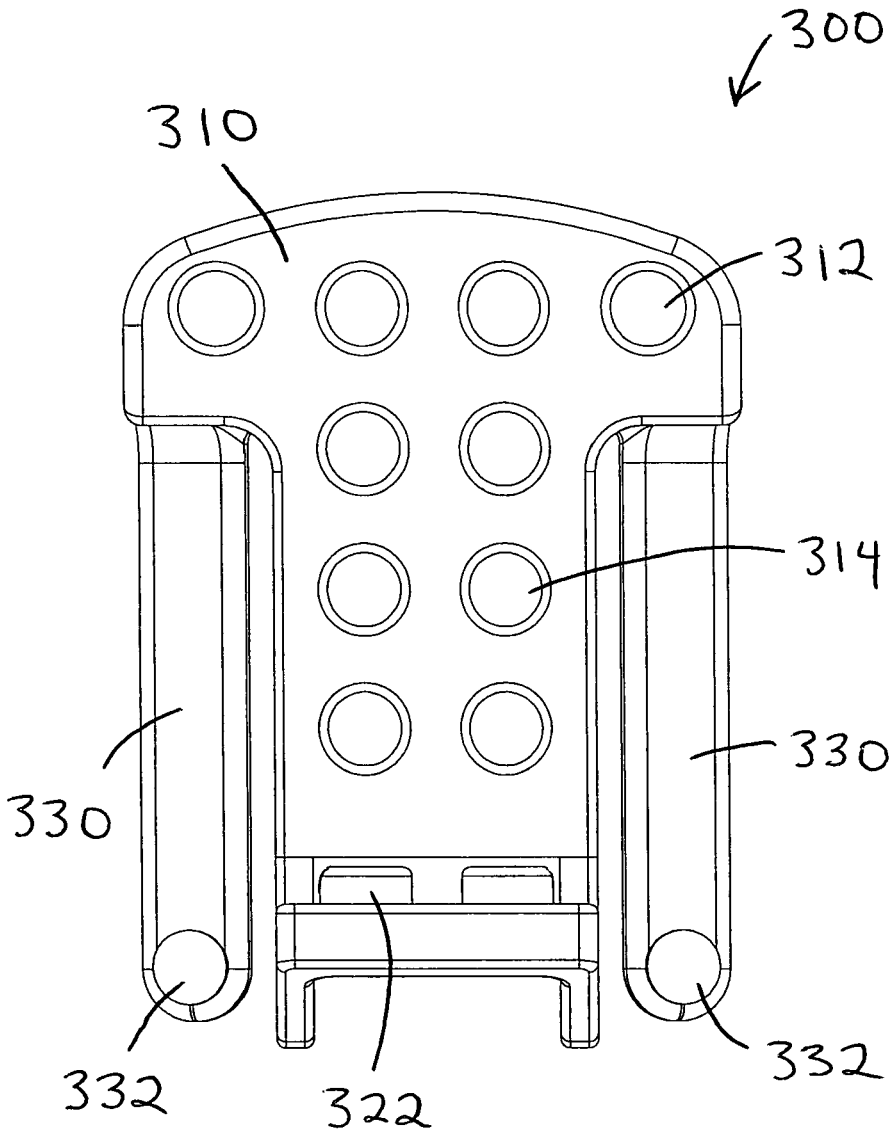
FIG. 19 is a top view of the apparatus of FIG. 17.
Figure 20:
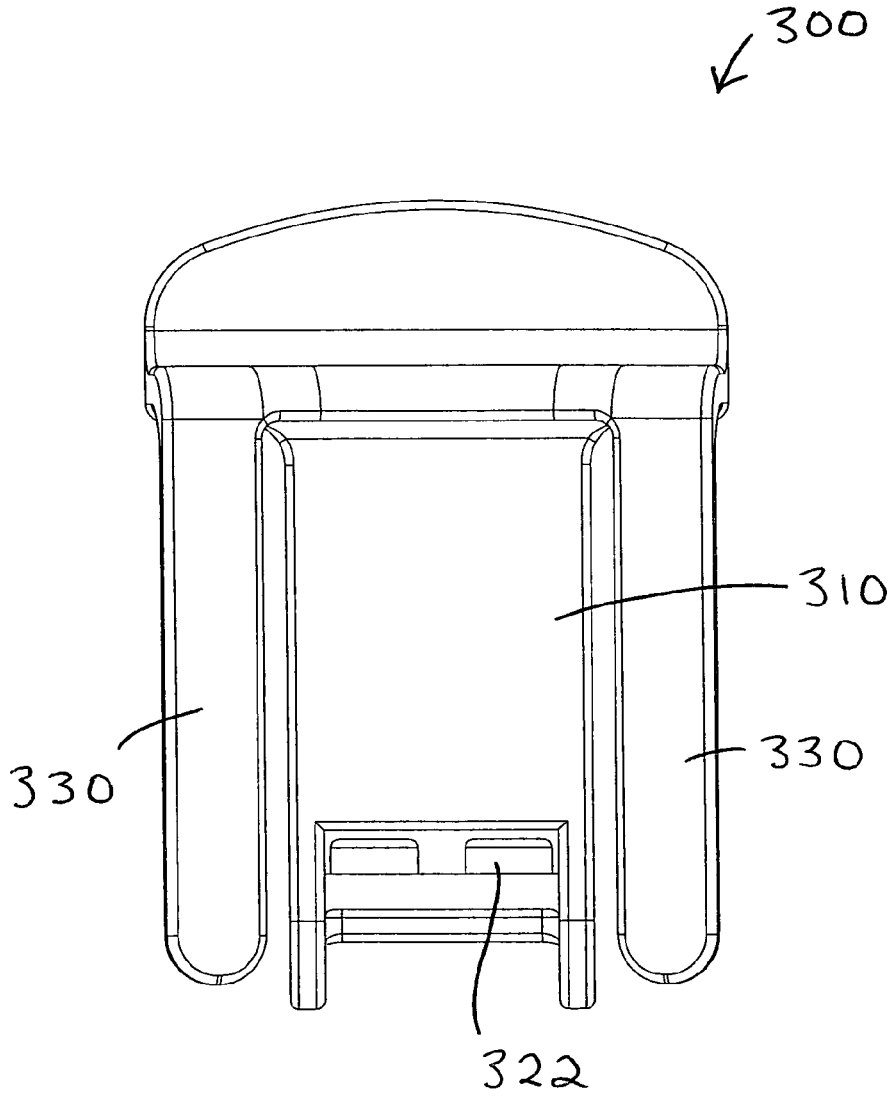
FIG. 20 is a bottom view of the apparatus of FIG. 17.
Figure 21:
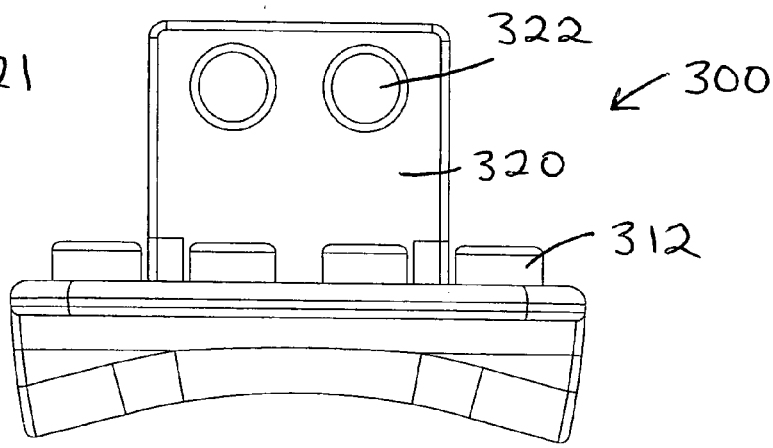
FIG. 21 is an end view of the apparatus of FIG. 17.
Figure 22:
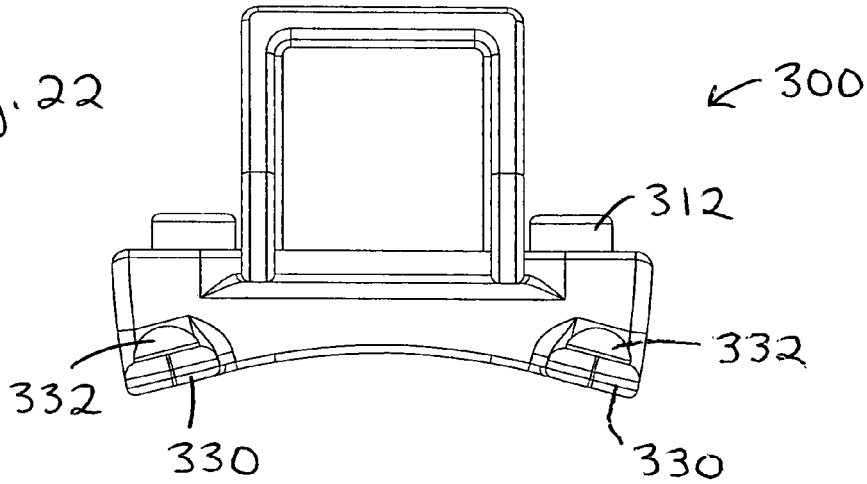
FIG. 22 is an opposite end view of the apparatus of FIG. 17.

A third apparatus constructed according to the principles of the present invention is designated as 300 in FIGS. 17-24. The apparatus 300 is preferably a single piece of injection molded plastic. The apparatus 300 has a base 310 which may be described in terms of a flat panel having a T-shaped planform, and opposite side prongs or tabs 330 that project outward from respective ends of the T-shaped panel, and in the same direction as the center portion of the T-shaped panel. Each prong 330 terminates in a distal end, and a respective peg or nub 332 projects outward from each distal end. As shown in FIGS. 18 and 22, the T-shaped panel is offset or displaced relative to the prongs 330, in a direction perpendicular to the T-shaped panel, and the prongs 130 are configured and arranged to tilt away from each other to accommodate a curved sheet of material therebetween. In other words, the T-shaped panel is configured and arranged to occupy an overlying position relative to a the bill of a visor, as well as a shoe closure or a shirt pocket, whereas the prongs 330 are configured and arranged to occupy respective underlying positions relative to the bill of the visor, the shoe closure, or the shirt pocket.

Two sets of pegs 312 and 314 project outward from a first side of the base 310. One set of pegs may be described as a row of four pegs 312 extending along one end of the base 310, perpendicular to the prongs 330. The other set of pegs may be described as a two-by-three array of pegs 314 extending perpendicular to the row of pegs 312 and aligned with the middle two pegs 312. A flange 320 projects upward from the same first side of the base 310 proximate an opposite end of the base 310. Another, third set of pegs 322 projects outward from the flange 320 toward the pegs 312 and 314, and in a direction orthogonal to the direction in which the pegs 312 and 314 project.

The pegs 312, 314, and 322 are preferably similarly configured and aligned with one another, so that a first peg from each set shares a first common plane of symmetry (extending perpendicular through the central flange 320), and a second peg from each set shares a second common plane of symmetry (extending perpendicular through the central flange 320). The pegs 312, 314, and 322 are configured and arranged to press fit into adjacent openings in commercially available LEGO products, including openings in the feet 92 of a commercially available LEGO figurine (designated as 90 in FIGS. 23-24).

Figure 23:
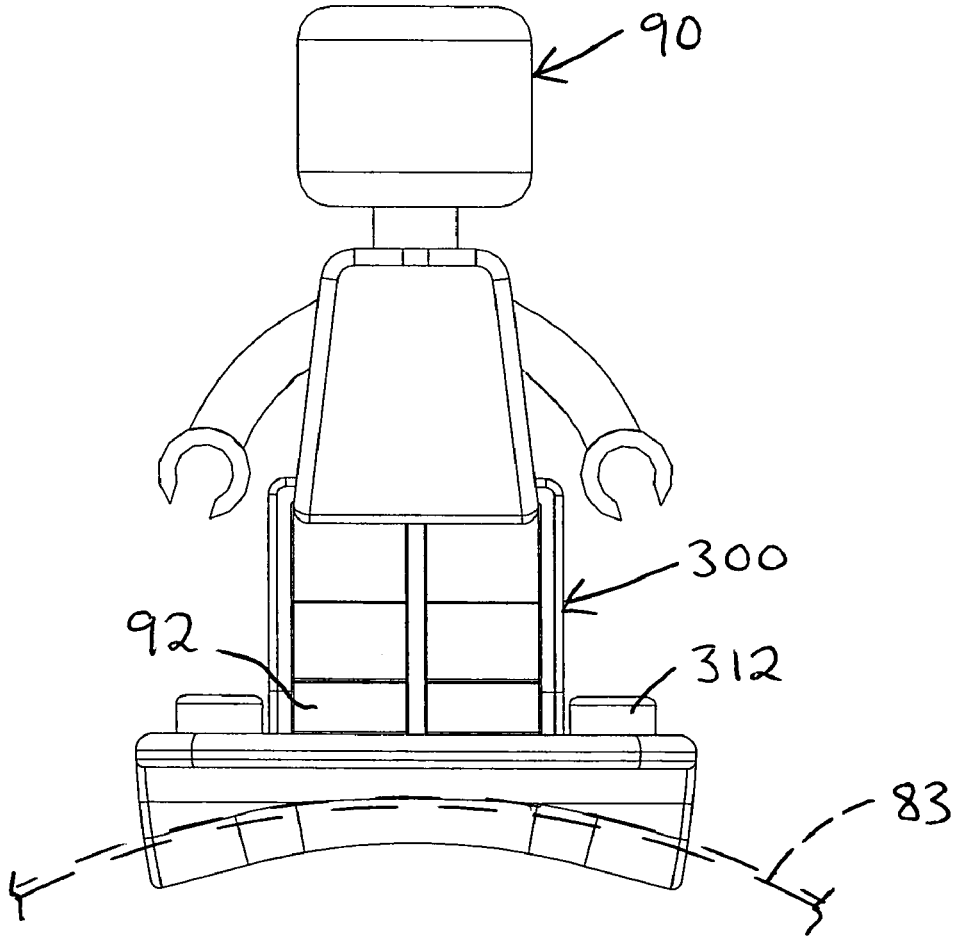
FIG. 23 shows the apparatus of FIG. 17 secured to an article of clothing, and a figurine mounted in a first position on the apparatus.

In one mode of operation, shown in FIG. 23, the apparatus 300 is arranged relative to an article of clothing 83, and a LEGO figurine 90 is mounted on the pegs 312. The article of clothing 83 is drawn diagrammatically to represent either a visor, a shoe having laces, or a shoe having hook-and-loop closures. In the case of the shoe, the apparatus 300 is preferably arranged so the pegs 322 project toward the toe of the shoe (and toward the reader), and the prongs 330 are inserted beneath at least one closure on the shoe 83. As a result, the figurine 90 occupies a standing orientation on top of the shoe 83. For additional understanding of this particular arrangement, one may refer to U.S. Pat. Nos. 6,412,197 and 6,640,467 to Krull, which are incorporated herein by reference.

Contrary to the prior art devices disclosed in the above-referenced patents, additional pegs 312 and 314 provide alternative locations for supporting the figurine in a standing orientation on the shoe, or for supporting more than one figurine, and/or LEGO blocks. In other words, an assembly of LEGO components may be built on the apparatus 300. In the alternative, the figurine 90 may be press fitted onto the pegs 322 to place the figurine 90 in a supine orientation on top of a shoe, or in a sitting position on top of a shoe. In this regard, an article of clothing designated as 84 in FIG. 24 may be construed as a shoe viewed from above, with the apparatus 300 arranged in the same manner as described with reference to FIG. 23 (but with the figurine 90 repositioned).

Figure 24:
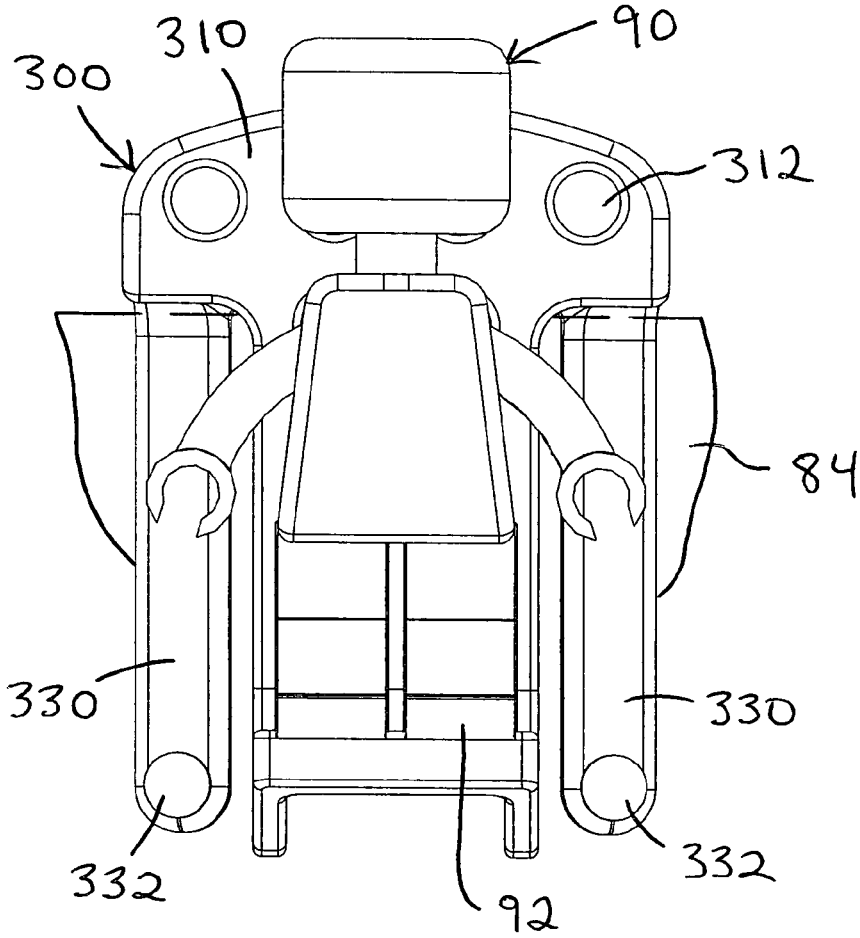
FIG. 24 shows the apparatus of FIG. 17, secured to an article of clothing, and a figurine mounted in a second position on the apparatus.

With reference back to FIG. 23, when the article of clothing 83 is a visor, the apparatus 300 is preferably arranged so the pegs 322 project toward the front edge of the bill (and toward the reader), and the prongs 330 are inserted beneath the bill, and the remainder of the apparatus 300 is inserted above the bill. As a result, the figurine 90 occupies a standing orientation on top of the bill of the visor 83, proximate the front edge thereof. Again, the various pegs 312, 314, and 322 accommodate various arrangements of one or more figurines and/or one or more LEGO blocks. For example, FIG. 24 shows how the figurine 90 may be arranged to assume a supine position on top of the visor, or a sitting position on top of the visor (by bending the figurine 90 at the waist).

In a modified application involving a visor, a first apparatus 300 may be mounted on a first side of a visor, and a second apparatus 300 may be mounted on a second side of a visor, and a LEGO structure may be interconnected therebetween. In this instance, it would be desirable to provide wedge-shaped LEGO-compatible blocks to "level" the structure relative to each apparatus 300. Such blocks would have pegs that project upward in a first direction, and openings that open downward in a second direction, and the angle between the two directions would preferably be one-hundred and seventy degrees, thereby allowing leveling in ten degree increments.

In yet another mode of operation, the article of clothing 84 may be construed as the front panel of a shirt pocket. In this application, the apparatus 300 is arranged so the pegs 322 project upward, and the prongs 330 are inserted behind the front panel 84 of the shirt pocket, with the remainder of the apparatus 300 in front of the panel 84 or above the shirt panel 84. The figurine 90 is press fitted onto the pegs 322 to place the figurine 90 in a standing orientation in front of the shirt pocket 84.

Figure 25:
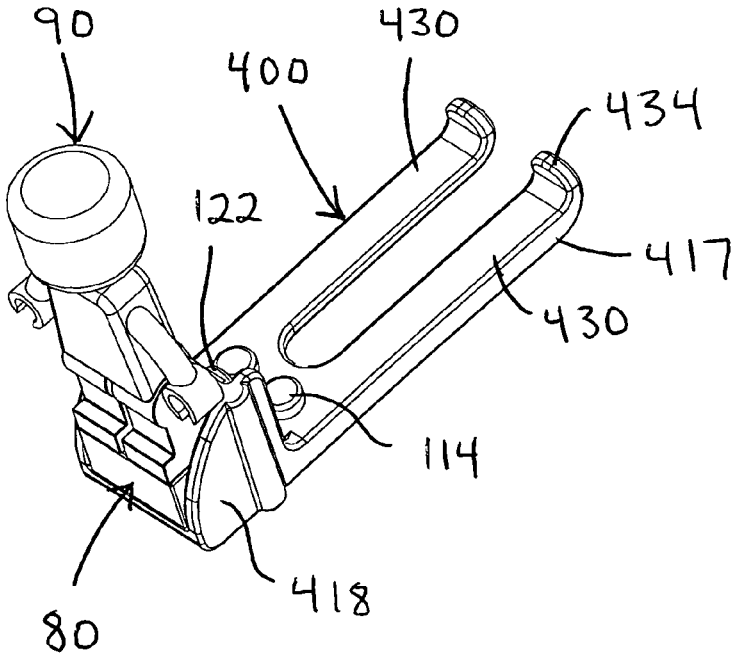
FIG. 25 is a perspective view of still another apparatus constructed according to the principles of the present invention, with a conventional LEGO block press fitted onto the apparatus, and a conventional LEGO figurine press fitted onto the LEGO block.

A fourth apparatus constructed according to the principles of the present invention is designated as 400 in FIG. 25. The apparatus 400 is similar in many respects to the second apparatus 200, but is designed solely for connection to a person's shoe. Accordingly, the description of this apparatus 400 will focus on elements not already discussed with reference to the apparatus 200. The apparatus 400 has a base which may be described as a flat panel having a generally U-shaped configuration, including left and right prongs 430. Opposite side flanges 417 project downward from a bottom side of the base, and extend along respective edges of the prongs 430 to enhance the structural integrity of the apparatus 400. Each prong 430 terminates in a distal end having an upwardly extending tip 434 and a downwardly rounded corner. The prongs 430 are configured and arranged for insertion beneath a closure on a shoe, and in the case of lace-type closures, for avoiding any obstructions along the center of the tongue portion of the shoe.

The apparatus 400 has the exact same arrangement of pegs 112, 114, and 122 as the first embodiment 100. Different sidewalls or flanges, including sidewall 418 are disposed on the base and/or about the pegs, but the function of such flanges is the same as on the first two embodiments 100 and 200. As discussed with reference to previous embodiments (but not shown), a conventional LEGO block 80 is press fitted onto the pegs 112. Additional LEGO blocks may be press fitted onto the apparatus 400 and/or the block 80, and/or at least one figurine 90 may be press fitted onto the apparatus 400 or any of the LEGO blocks.

As used herein, the term "figurine" is hereby defined as a small-scale three-dimensional representation of a person, animal, or fictional character. For example, a humanoid figurine would typically include at least a torso, two legs terminating in feet, two arms terminating in hands, and a head. The depicted embodiments are adapted specifically for use with LEGO figurines that meet this definition, but alternative embodiments may be provided with alternative connector members for other types of figurines. Some examples of alternative connector members are disclosed in the patents incorporated herein by reference.

All of the depicted embodiments may be described as releasably secured to articles of clothing in a non-invasive manner (no pins), and/or as retained in place by friction and/or gravity. To the extent that discrete portions of certain embodiments capture an article of clothing therebetween, those embodiments may also be described as clips or as clipped onto an article of clothing. Also, as used herein, the term "visor" is hereby defined to mean a piece of headgear, including a cap or a hat, that has at least a head-engaging member, and a bill that projects outward above a person's eyes.

Each Figure is drawn to scale, and the LEGO supporting pegs are identical to those on conventional LEGO blocks. As a result, other LEGO products may be secured to the depicted embodiments in lieu of the figurines. Moreover, alternative embodiments of the present invention may be derived for use with LEGO blocks apart from attachment to articles of clothing.

The present invention has been described with reference to particular embodiments and specific applications. To the extent that similar features are present on two discrete embodiments, any description of such features with reference to one embodiment is applicable to those same features on the other embodiments. Moreover, the present invention may also be described in terms of combinations of an embodiment of the invention and an article of clothing to which the embodiment is secured. Additionally, the present invention may be described in terms of various methods with reference to the aforementioned embodiments and/or combinations, including, for example, a method of adorning at least one article of clothing, a method of storing at least one figurine, and/or a method of supporting at least one LEGO compatible item. Finally, recognizing that the foregoing description will lead persons skilled in the art to recognize additional embodiments, variations, and/or applications of the present invention, the scope of the present invention is to be limited only to the extent of the following claims.

What is claimed is:

1. An apparatus, comprising:

a base configured for releasable attachment to an article of clothing, wherein the base has an end portion and at least two discrete legs that extend in a common direction away from the end portion to selectively extend along respective, opposite sides of an element of the article of clothing, and the base defines a first surface and a second surface, and an angle of ninety degrees is defined between the first surface and the second surface;

at least one array of first pegs integrally connected to the base, configured for insertion into a block, and projecting perpendicularly outward from the first surface;

at least one array of second pegs integrally connected to the base, configured for insertion into a block, and projecting perpendicularly outward from the second surface; and a figurine, wherein the figurine is selectively connected to the first pegs and alternatively, selectively connected to the second pegs.

2. The apparatus of claim 1, wherein the figurine is configured to occupy a free standing, upright position on a flat support surface when removed from the base.

3. The apparatus of claim 1, wherein a block is interconnected between the base and the figurine.

4. An apparatus, comprising:

a base defining a first surface and a second surface, wherein an angle of ninety degrees is defined between the first surface and the second surface, and including connecting means for removably connecting the base to an article of clothing;

at least one array of first pegs integrally connected to the base, configured for insertion into a block, and projecting perpendicularly outward from the first surface;

at least one array of second pegs integrally connected to the base, configured for insertion into a block, and projecting perpendicularly outward from the second surface; and a three-dimensional figurine selectively connected to the first pegs and alternatively, selectively connected to the second pegs.

5. The apparatus of claim 4, wherein the connecting means removably connects the base to a person's shoe.

6. The apparatus of claim 4, wherein the connecting means removably connects the base to a person's shirt.

7. The apparatus of claim 4, wherein the connecting means removably connects the base to a person's visor.

8. An apparatus, comprising:

a base configured for releasable attachment to an article of clothing, wherein the base has an end portion and at least two discrete legs that extend in a common direction away from the end portion to selectively extend along respective, opposite sides of an element of the article of clothing, and the base defines an upwardly facing surface;

at least two pegs integrally connected to the base, configured and arranged for insertion into a block, and projecting perpendicularly outward from the upwardly facing surface;

a figurine selectively connected to the pegs; and at least one flat wall integrally connected to the base and projecting perpendicularly outward from the upwardly facing surface.

9. The apparatus of claim 8, further comprising at least two discrete pegs configured and arranged for insertion connection into a block, and projecting perpendicularly outward from the wall.

10. The apparatus of claim 8, wherein the figurine defines a flat surface that is disposed directly adjacent the at least one wall, whereby the at least one wall cooperates with the flat surface to discourage tipping of the figurine relative to the at least two pegs.

11. An apparatus, comprising:

a base, including connecting means for removably connecting the base to an article of clothing, and defining an upwardly facing surface;

at least two pegs integrally connected to the base, configured and arranged for insertion into a block, and projecting perpendicular outward from the upwardly facing surface;

at least one flat wall integrally connected to the base and projecting perpendicularly outward from the upwardly facing surface; and a three-dimensional figurine selectively connected to the pegs.

12. The apparatus of claim 11, further comprising at least two second pegs that (i) project outward from the wall in a direction parallel to the upwardly facing surface, and (ii) are configured and arranged for insertion into a block.

13. The apparatus of claim 11, wherein the connecting means alternatively connects the base to a shirt and a visor.

14. The apparatus of claim 9, wherein said at least two pegs on the wall project outward from a surface of the wall facing toward said at least two pegs on the upwardly facing surface.

15. The apparatus of claim 4, wherein a hole extends through the base in a direction perpendicular to the first surface and at a location directly underlying said at least one array of second pegs.

16. The apparatus of claim 1, wherein at least one said array is disposed on an end of said one of the legs opposite the end portion of the base.

17. The apparatus of claim 1, wherein one of said legs is centered between two other said legs.

18. The apparatus of claim 1, wherein a wall projects outward from the base in a direction perpendicular to said common direction.

19. The apparatus of claim 18, wherein the figurine defines a flat surface that is disposed directly adjacent a flat side of the wall when the figurine is connected to the array of first pegs, whereby the flat side of the wall cooperates with the flat surface to discourage tipping of the figurine relative to the array of first pegs.

20. The apparatus of claim 19, wherein the second surface is disposed on a side of the wall opposite said flat side.

21. The apparatus of claim 1, wherein one said array is disposed on the end portion of the base, and another said array is disposed on one of the legs.

22. The apparatus of claim 1, wherein at least one said array is disposed on one of the legs.

* * * * *